US011381048B2

(12) United States Patent
Pletsch

(10) Patent No.: US 11,381,048 B2
(45) Date of Patent: Jul. 5, 2022

(54) CRIMPING TOOL LOCATOR AND CRIMPING TOOL

(71) Applicant: WEZAG GmbH Werkzeugfabrik, Stadtallendorf (DE)

(72) Inventor: Martin Pletsch, Gemuenden (DE)

(73) Assignee: WEZAG GmbH & Co. KG, Stadtallendorf (DE)

( * ) Notice: Subject to any disclaimer, the term of this patent is extended or adjusted under 35 U.S.C. 154(b) by 299 days.

(21) Appl. No.: 15/695,692

(22) Filed: Sep. 5, 2017

(65) Prior Publication Data

US 2018/0083403 A1 Mar. 22, 2018

(30) Foreign Application Priority Data

Sep. 22, 2016 (EP) ..... 16190245

(51) Int. Cl.
*H01R 43/042* (2006.01)
*B25B 27/14* (2006.01)
*B25B 27/10* (2006.01)

(52) U.S. Cl.
CPC ..... *H01R 43/042* (2013.01); *B25B 27/10* (2013.01); *B25B 27/146* (2013.01); *H01R 43/0421* (2013.01)

(58) Field of Classification Search
CPC .... H01R 43/04; H01R 43/042; H01R 43/045; B21D 39/048
See application file for complete search history.

(56) References Cited

U.S. PATENT DOCUMENTS 2,765,688 A * 10/1956 Evans ..... H01R 43/042 72/404
2,953,185 A 9/1960 Lazar
3,142,209 A * 7/1964 Demler ..... H01R 43/042 72/407
3,457,764 A 7/1969 McKee
3,571,888 A * 3/1971 Di Filippo ..... H01R 43/042 29/751

(Continued)

FOREIGN PATENT DOCUMENTS

CN 1236538 6/1993
DE 27 18 165 A1 10/1978

(Continued)

OTHER PUBLICATIONS

Molex, Hand Crimp Tool Specification Sheet Order No. 63819-6400, Aug. 12, 2009, p. 1-6, https://www.mouser.com/ds/2/276/ATS-638196400-155492.pdf (Year: 2009).*

(Continued)

*Primary Examiner* — Gregory D Swiatocha
*Assistant Examiner* — Bobby Yeonjin Kim
(74) *Attorney, Agent, or Firm* — The Sladkus Law Group

(57) ABSTRACT

The invention relates to a crimping tool locator (12) for a crimping tool (1), especially crimping plier (2). The crimping tool locator (12) comprises an accommodating body (14) with at least one accommodation (21) for a workpiece (10), especially a plug (11). The accommodating body (14) comprises a securing device (24), by which the workpiece (10) is securable in the interior of the accommodation (21). The securing device (24) can be realized as a latching device, locking device or friction device.

14 Claims, 13 Drawing Sheets

(56) References Cited

U.S. PATENT DOCUMENTS

| | | | | |
|---|---|---|---|---|
| 3,751,963 | A * | 8/1973 | Munshower | H01R 43/042 72/409.08 |
| 4,719,789 | A * | 1/1988 | Wiebe | H01R 43/042 29/751 |
| 4,974,314 | A * | 12/1990 | Nickerson | H01R 43/042 29/751 |
| 5,153,984 | A | 10/1992 | Beetz et al. | |
| 6,155,095 | A | 12/2000 | Beetz | |
| 6,612,147 | B2 | 9/2003 | Beetz et al. | |
| 6,877,228 | B2 | 4/2005 | Beetz et al. | |
| 8,161,789 | B2 | 4/2012 | Battenfeld et al. | |
| 8,230,715 | B2 | 7/2012 | Battenfeld et al. | |
| 8,296,956 | B2 | 10/2012 | Battenfeld | |
| 8,601,856 | B2 * | 12/2013 | Battenfeld | H01R 43/042 29/751 |
| 10,454,232 | B2 * | 10/2019 | Kerstetter | H01R 43/048 |
| 2014/0260502 | A1 * | 9/2014 | Wang | B21D 41/04 72/367.1 |

FOREIGN PATENT DOCUMENTS

| | | |
|---|---|---|
| DE | 40 23 337 C1 | 10/1991 |
| DE | 44 27 553 C2 | 6/1998 |
| DE | 198 32 884 C1 | 12/1999 |
| DE | 100 56 900 C1 | 8/2002 |
| DE | 101 34 004 C1 | 2/2003 |
| DE | 101 32 413 C2 | 7/2003 |
| DE | 101 40 270 B4 | 9/2004 |
| DE | 20 2008 003 703 U1 | 6/2008 |
| DE | 10 2007 038 626 B3 | 10/2008 |
| DE | 10 2008 017 366 A1 | 10/2009 |
| DE | 10 2008 012 011 B3 | 12/2009 |
| DE | 10 2010 061 148 A1 | 6/2012 |
| EP | 0 125 708 A2 | 3/1984 |
| EP | 2 463 969 B2 | 12/2011 |
| EP | 2 672 580 A1 | 6/2012 |

OTHER PUBLICATIONS

Molex. "Hand Crimp Tool Specification Sheet Order No. 63819-6400." Mouser, Aug. 12, 2009, www.mouser.com/ds/2/276/ATS-638196400-155492.pdf. (Year: 2009).*

* cited by examiner

CRIMPING TOOL LOCATOR AND CRIMPING TOOL

CROSS REFERENCE TO RELATED APPLICATIONS

This application claims priority to co-pending European Patent Application No. EP 16 190 245.7 filed Sep. 22, 2016.

FIELD OF THE INVENTION

The invention relates to a crimping tool locator and a crimping tool with a crimping tool locator.

A crimping by means of the crimping tool can be achieved due to manual actuation, pneumatic or hydraulic actuation, actuation by an electrical actuation unit or any other actuation unit. Especially, the crimping tool is realized as manually actuated pressing pliers, which covers also so called crimping pliers.

By means of crimping tools, which can be equipped with a crimping tool locator according to the invention, a workpiece is crimped. For example, by means of a crimping tool workpieces embodied as plugs, contacts or pins or connectors (in the following: "plugs") can be crimped to a partially stripped end of a cable or conductor (in the following: "cable"). In the following, preferably reference will be made to a crimping of a plug to a cable and/or the realization of the crimping tool as crimping pliers, while the same shall apply for a crimping of other workpieces and/or another crimping tool.

BACKGROUND OF THE INVENTION

During the crimping over a working stroke of crimping pliers, the plug is plastically deformed and pressed against the end of the cable arranged in the plug. In this way on one hand an electrical contact is established and on the other hand a mechanical connection between the plug and the end of the cable is established which is as permanent as possible. With regard to possible realizations of the crimping pliers on the one hand and the plug and the types of the cables crimped with it on the other hand it is referred especially to the embodiments shown and described in the catalogue "Werkzeuge für die professionelle Anwendung" of WEZAG GmbH Werkzeugfabrik (printing remark "Dokument Nr. Kat. 10/11").

For an exact and defined crimping of the plug it is necessary that the plug and the cable are arranged in the intended position and orientation relative to tool halves of the crimping pliers forming at least one die half, so that with the closing of the tool halves over the working stroke of the crimping pliers the desired plastic deformation can be induced and the crimping result attained on the crimped plug conforms with high standards of precision.

For setting the position and orientation of the plug relative to a die formed with two corresponding die halves of a tool half at the begin of the working stroke, crimping tool positioners (also referred to as "locators" in English use) are employed. Such a crimping tool locator serves for adequately setting the position and the orientation of the plug relative to the pliers head, especially for setting the correct axial position of the plug with respect to the end of the cable and/or for setting the coaxial orientation of the plug with respect to the end of the cable. The crimping tool locator on the one hand makes sure that at the beginning of the crimping stroke the plug is already positioned correctly with respect to a die of the pliers head. On the other hand it is also possible that during the crimping stroke the crimping tool locator proper secures the relative position and orientation of the plug with respect to the die and the end of the cable at the execution of the working stroke during the plastic deformation of the plug.

Known crimping tool locators comprise at least one accommodation into which the plug can be inserted in such a way that the plug has a defined position and orientation with respect to the crimping tool locator. The crimping tool locator then is also mounted with a defined position and orientation on the pliers head in which the two halves are movably guided and driven in such a way that the plug inserted into the crimping tool locator comprises a defined position and orientation with respect to the tool halves and therefore with respect to a die.

With respect to the mechanical basic composition of crimping pliers and the pliers head, the realization of the crimping tool locator and the design of possible degrees of freedom of motion of the crimping tool locator from prior art multitudinous design possibilities are known (cp. also the embodiments of the crimping tools in the above-mentioned catalogue of WEZAG GmbH Werkzeugfabrik):

In the simplest case, an accommodating body of a crimping tool locator is mounted on the pliers head of the crimping pliers.

It is also possible, however, that a holding and guiding body of the crimping tool locator is mounted to the pliers head of the crimping pliers and an accommodating body of the crimping tool locator is movably held and guided on the holding and guiding body.

Crimping pliers known from DE 27 18 165 A1 have a pliers head with a C-shaped frame so that in this case the pliers head is open on the side. In another embodiment according to DE 27 18 165 A1, crimping jaws and tool halves mounted on them move in a "scissor-like" way with respect to each other. In both cases, in the pliers head, a pliers head plane is defined in which the tool halves with the die halves move. The known crimping pliers have a crimping tool locator with an accommodating body which is pivotable around a pivoting axis between an insertion position and a working position. In the insertion position, an inserting, plugging of the plug onto or into at least one accommodation of the accommodating body can be achieved. In the working position, with running through the working stroke the crimping of the plug is achieved. The pivoting axis for the pivoting of the accommodating body is oriented vertically to the pliers head plane. For a crimping of a plug, to begin with the accommodating body of the crimping tool locator is pivoted into the insertion position. The plug then is inserted into an accommodation of the accommodating body and the accommodating body with the inserted plug is pivoted back into the working position through the opened side of the pliers head. In the working position the plug takes up the intended position and orientation with respect to the die halves. Subsequently, the plastic deformation of the plug can be achieved by means of the actual crimping process by actuating the drive of the crimping pliers, which is here constituted by two hand levers pivotable with respect to each other. In order to achieve a secure holding of the plug in the accommodation, on its upper side the accommodation is reached over by a leaf spring which exerts a force onto the plug at a location outside of the accommodation. This force presses the plug against the bottom of the accommodation and holds the plug by clamping. As an alternative to the employment of a leaf spring, the document DE 27 18 165 A1 also suggests that the plug is held in the accommodation by a pin extending in the longitudinal direction of the plug. By the pin the plug can be held on its own by a contact spring arm of the plug. For the purpose to avoid that the plug glides out in a direction perpendicular to the insertion opening of the accommodation, the accommodation is realized as an insertion groove open to the upper side, where on the upper side the insertion groove is covered and closed by a small plate screwed onto it.

Other crimping pliers are sold by WEZAG GmbH Werkzeugfabrik under the label CS20KS. These crimping pliers also have a C-shaped pliers head open to one side. On this pliers head, an accommodating body of a crimping tool locator is linearly guided on an axis fixed to the pliers head. The axis is oriented parallel to the lower horizontal arm of the C and is arranged in a plane parallel to the pliers head plane. The accommodating body can be moved by a pivotable lever supported on the pliers head from the working position into the insertion position. A manually induced pivoting motion of the lever via a connection between a pin guided in an elongated hole is converted into a linear motion along the axis for a linear motion of the accommodating body.

Furthermore, crimping pliers of the applicant with label CS25KS are known, which also have a C-shaped pliers head. In these crimping pliers, an accommodating body of a crimping tool locator is supported for a pivoting movement with respect to the pliers head around a pivoting axis oriented vertically to the pliers head plane. Via the rotation of a knurl the accommodating body is pivotable parallel to the pliers head plane between an insertion position and a working position.

DE 198 32 884 C1 (corresponding to U.S. Pat. No. 6,155,095 A) discloses crimping pliers with a pliers head in a plate construction mode—The pliers head is not C-shaped with a one-sided opening but O-shaped without an opening in the circumferential direction. According to an actuation of hand levers, a moveable tool half is slidable in the direction of a longitudinal axis relative to a tool half fixed with respect to the pliers head. DE 198 32 884 C1 proposes a crimping tool locator with an accommodating body which is pivotable around a pivoting axis which is oriented in parallel to the pliers head plane and transverse to the direction of motion of the tool halves of the crimping pliers. In a working position, the crimping tool locator is oriented generally in parallel to the pliers head plane. From this working position, the pliers head locator can be pivoted around the pivoting axis out of the pliers head plane into the insertion position.

For the crimping tool locators explained before the motion of the accommodating body of the crimping tool locator necessitates holding the crimping pliers with one hand of the user, for example in the region of hand levers, while the other hand of the user moves the accommodating body of the crimping tool locator from a working position into an insertion position (or the other way around). Instead, DE 10 2008 017 366 A1 (corresponding to U.S. Pat. No. 8,161,789 B2) proposes a crimping tool locator with a pivotable accommodating body on which a cantilever is fixed. The operating surface of the cantilever is guided in proximity to the hand levers of the crimping pliers in such a way that with the thumb of the hand which holds the crimping pliers in the region of the hand levers, the accommodating body of the crimping tool locator can be pivoted, in which way a simplified operation, especially a one-handed operation is enabled.

DE 10 2008 012 011 B3 (corresponding to U.S. Pat. No. 8,230,715 B2) discloses a pliers head in which tool halves with multiple die halves with different crimping contours are moveable transverse to the pliers head and transverse to the crimping axis, so that depending on the plug to be crimped different die halves can be arranged coaxially or centrally to the crimping axis in the pliers head. In this way, the force conditions for the die halves used for different plugs can be optimized and/or the number of die halves with different geometries that can be used in a tool half can be increased.

DE 10 2010 061 148 A1 (corresponding to U.S. Pat. No. 8,601,856 B2) describes crimping pliers wherein the two hand levers in the end region turned towards the crimping head are supported in a pivot bearing connected to a moveable tool half. Furthermore, the hand levers are each pivotably linked to an end region of draw bars which are linked to an O-shaped frame of the pliers head in the other end region. On the frame of the pliers head, a tool half is fixed. Onto the fixed tool half, a holding and guiding body of a crimping tool locator is screwed. On the holding and guiding body, an accommodating body of the crimping tool locator is moveably supported. The accommodating body can be moved relative to the holding and guiding body in a direction transverse to the relative motion of the tool halves (and therefore transverse to the crimping axis). The tool halves each have several die halves lying next to each other in a direction transverse to the crimping axis. With the moving of the accommodating body relative to the holding and guiding body, an accommodation of the accommodating body for a plug can be arranged behind different die halves of a tool half or different accommodations of the accommodating body can be arranged behind the same die half. Therefore, depending on the position of the accommodating body, a die half can enter into interaction with different plugs, which may have been inserted in different accommodations of the accommodating body, and/or different die halves can enter into interaction with plugs inserted into the same accommodation of the accommodating body. As an alternative to using a translatory degree of freedom of the accommodating body with respect to the holding and guiding body transverse to the crimping axis, DE 10 2010 061 148 A1 also proposes that the accommodating body is rotatable in revolver-like way with respect to the holding and guiding body around a rotational axis oriented vertically to the pliers head plane. In this case, single accommodations of the accommodating body are distributed over the circumference and/or are provided with different radii from the rotational axis of the revolver on the accommodating body. Accordingly, depending on the rotational angle of the accommodating body these accommodations can be arranged behind a die half. It is possible that a latching or locking of the accommodating body with respect to the holding and guiding body is done in order to secure an operating position of the accommodating body. DE 10 2010 061 148 A1 also proposes an especially compact design of the crimping tool locator. For this design it is also possible that the extension of an accommodation of the crimping tool locator is larger than the distance between two neighboring die halves of a tool half.

DE 20 2008 003 703 U1 discloses pliers in which an accommodating body of a crimping tool locator is pivotable around a pivoting axis between an insertion position and a working position. The pivoting axis is oriented in parallel to the crimping axis and the pliers head plane. A locking (unyielding or yielding in a limited way) of the accommodating body in the working position is proposed. The locking can be achieved via a blocking bar, which is supported for being pivoted around a pivoting axis oriented vertically to the pliers head plane on a pivoting bolt of the holding and guiding body. Furthermore, on the accommodating body a securing element is supported for being pivoted around a pivoting axis oriented radially to the pivoting axis for the pivoting of the accommodating body relative to the holding and guiding body and parallel to the main axis of extension of the accommodating body, which is realized as a stop rocker. In a securing position of the stop rocker, the stop rocker reaches around the accommodating body in the shape of a U. Outside of the accommodation of the accommodating body for the plug, a lug or a protrusion of a side arm of the U engages with a groove or an indentation of the plug. In this way the plug is intended to be secured against an unintended falling out of the accommodation of the accommodating body. Furthermore, the protrusion or the lug forms a further stop. In the working position of the accommodating body the further stop limits an insertion depth of the partially stripped cable. In this way, it is to be made sure that a crimping of the plug to the cable is done in a defined axial relative position of the cable in the plug. By means of a spring, the stop rocker is biased into the securing position, while it can be manually moved out of the securing position against the biasing by the spring.

EP 2 672 580 A1 discloses crimping pliers with different drive kinematics, in which a crimping tool locator (here with an accommodating body which is pivotable around a pivoting axis oriented parallel to the crimping axis) can also be employed.

DE 101 34 004 C1 discloses a crimping tool locator which is fixed to a moveable pliers jaw by a U-shaped holding bracket. Via two angled elongated holes in the side arms of the U-shaped holding bracket an accommodating body is guided for being moveable in a translatory way and for being pivoted. In a state pushed away from the moveable pliers jaw and additionally folded away, plugs can be inserted into accommodating pockets of the accommodating body. A clamping spring reaches over the accommodating body and clamps the plug with a clamping lip at a location outside of the accommodating pockets in order to arrest it and to hold it. Since the clamping lip engages with a correspondingly formed indentation of the plug, it also defines the insertion depth of the plug into the accommodating pocket.

EP 0 125 708 A2 discloses a crimping tool locator which is fixedly mounted to a pliers jaw. An accommodation of the crimping tool locator is realized with a slit on the upper side where in the slit a slotted link is guided while biased by a spring. With the insertion of a plug through the dies of the pliers jaws into the accommodation, the front face of the plug can push the slotted link upwards or pivot it until the front face of the plug comes to rest against a protrusion of the slotted link. In this way the insertion depths of the plug into the accommodation is defined. For the use of the crimping tool locator for another plug with a larger required insertion depth, the slotted link can be moved manually further out of the accommodation, so that the protrusion does no longer hinder the insertion of the plug. In this case, the plug can be inserted into the accommodation up to a bottom of the accommodation. In this state, the slotted link can again be released by the user. In this way, due to the bias of the spring with the protrusion the slotted link presses the plug onto the bottom of the accommodation.

Further prior art is known from documents U.S. Pat. Nos. 3,142,209 A, 3,457,764 A, 2,953,185 A and 3,751,963 A.

SUMMARY OF THE INVENTION

It is an object of the present invention to propose a crimping tool locator which is improved with respect to usage especially considering the demands of construction space. Furthermore, it is an object of the invention to propose a correspondingly improved crimping tool.

The crimping tool locator according to one embodiment of the invention comprises an accommodating body. The accommodating body can be realized as one-parted or multi-parted or as one-piece or multi-piece and be fixed or moveable, especially slidable or pivotable or rotatable in a revolver-like way, be held on the crimping tool for a motion between an insertion position and a working position (cp. the prior art mentioned in the beginning). The accommodating body comprises an accommodation (or at least one accommodation) for a workpiece. The accommodation is formed especially by a recess of the accommodating body, possibly with a suitable lining, and the cross section of the accommodation is limited (with open or closed boundaries) by the material of the accommodating body.

One embodiment of the present invention in particular bases on the finding that for embodiments known from prior art, a plug is loosely accommodated in the fixedly defined cross section of the accommodation, especially with a clearance fit or a transition fit. Due to the own weight of the plug and/or the chosen fit between the outer cross section of the plug and the inner cross section of the accommodation, there is friction between the plug and the accommodation, while depending on the orientation of the crimping tool the plug can also get "jammed" in the accommodation. Due to friction and a possible jamming, the plug is generally secured in the accommodation in such a way that it can be made to approach the cable with the crimping tool and be brought into effective interaction with the cable so that the crimping can be done. It has emerged, however, that the plug repeatedly falls out of the accommodation, which is for example the case when the crimping tool has to be brought to the cable in situations under tight construction room conditions and while changing its orientation. Especially under the tight construction room conditions, it can also be problematic to pick up a plug fallen out of the accommodation and to bring it back to the accommodation.

According to one embodiment of the invention it is suggested that the accommodating body comprises a securing device. By the securing device the workpiece can be secured in the interior of the accommodation. Therefore, via the securing device (possibly in addition to a possible friction due to the own weight of the workpiece or a jamming of the plug) the plug is secured with respect to unintentionally falling out. The securing device especially produces a securing force which is independent of the own weight of the workpiece. Preferably, the securing device is realized in such a way that via the securing device a (partial) cross section of the accommodation is changeable between a non-securing (partial) cross section in which the plug is insertable into the accommodation while forming an insertion clearance and (together with the attached cable) can be removed from it and a securing (partial) cross section which is smaller than the non-securing (partial) cross section and in which the plug is secured in the accommodation so that it cannot easily fall out of the accommodation.

Within the framework of the invention, the securing device is preferably integrated into the accommodation or adjoins an interior surface of the accommodation. The interaction between the plug and the securing device therefore is created in the interior of the accommodation (and not outside of it and especially not axially before or behind the accommodation). A cross section of the accommodation can be limited by a securing element of the securing device.

In deviation to securing the plug via a stop rocker according to DE 20 2008 003 703 U1, according to one embodiment of the invention the securing is achieved via the securing device in the interior of the accommodation, in which way the demands of construction space can be reduced on the one hand with respect to the crimping tool and the crimping tool locator and on the other hand with respect to the design of the plug to be secured.

Possibly, via the securing device according to the invention it can also be made possible for plugs of different types or geometries to be held in the same accommodation since the securing device can guarantee a certain adaptability.

According to one embodiment of the invention, the securing device comprises a securing element. The securing element comprises two different positions, that is, a secured position and an unsecured position. In the secured position, a workpiece arranged in the accommodation is secured. On the contrary, in the unsecured position, the workpiece arranged in the accommodation is unsecured or a workpiece can be inserted into the accommodation or removed from it. Preferably, in the secured position the securing element decreases the size of the (partial) cross section of the accommodation, in which way the securing effect is achieved. To mention only some non-limiting examples, this decrease can be a decrease, or the motion of the securing element can be a motion larger than 0.01 mm, larger than 0.02 mm, larger than 0.05 mm, larger than 0.1 mm or even larger than 0.2 mm.

For the realization of the securing device and therefore for achieving the securing effect, within the framework of the invention there are the following non-limiting options:

For an embodiment of the invention, the securing device is realized as a latching device. As a latching device, especially a device is understood in which, while being biased by a spring element, a latching element engages with a latching recess, in which way the securing effect is created due to a latching force. Preferably, the latching element and/or the latching recess is contoured with suitable latching contours or inclined surfaces in such a way that

- at the application of insertion forces onto the plug, while biased by the spring element the latching device is moved in the direction of an opening position or a non-securing position and at reaching the latching position the spring element moves the latching element into the securing position, in which the latching element engages with the latching recess or reaches behind a latching protrusion, and/or
- at the application of removal forces onto the plug, while being biased by the spring element the latching element is moved in the direction of an opening position or non-securing position, until for reaching a threshold value of the releasing force the latching element leaves engagement with the latching recess or the latching protrusion, in which way the plug (with the cable fixed to it) can be moved out of the accommodation.

For such a latching device, due to the spring element the latching element automatically takes up the securing position, while with the application of insertion forces and/or removal forces while being biased by the spring element the latching element is brought into the non-securing position, in which then possibly, however, for moving the plug friction forces between the latching element and the plug also have to be overcome.

For another embodiment of the invention, the securing device is realized as a locking device. In a locking device, the plug is locked in the accommodation. As such, especially a form-locking between a locking element and a locking protrusion or a locking recess is understood, where in this case a locking cannot be released while being biased by a spring element by an application of sufficient insertion forces and/or removal forces onto the plug. Rather than that, a separate locking and/or unlocking via manual actuation of a separate locking actuation organ is necessary.

For a further embodiment of the invention, the securing device is equipped with a friction element. This friction element is supported via a spring element. The spring element presses the friction element against an outer surface of the workpiece. In this way, the workpiece can be secured by friction in the accommodation. Via suitable contouring of the outer surface of the workpiece, a changeable securing effect corresponding to the friction force can be created depending on how deep the workpiece has been inserted into the accommodation. By suitable choice of the material and the surface of the friction element and/or the workpiece, there can be a constructive influence on the friction conditions. Furthermore, influencing the friction conditions can be done by the dimensioning of the spring element, especially the choice of the stiffness of the spring element, the choice of the number of inserted spring elements and/or the length of the spring element.

The invention covers embodiments in which the latching element, the locking element or the friction element and/or the corresponding spring element is/are realized by the accommodating body in the region of the accommodation, while the friction surface interacting with the friction element, the latching protrusion or the latching recess for the latching engagement of the latching element or the locking protrusion or the locking recess for the present engagement of the locking element is realized by the workpiece.

According to a further proposal of the invention, the securing device comprises a manual actuation organ. By the manual actuation organ the securing device can be supported with respect to the securing effect, can be held in its operating position, can be manually operated and/or released. In this way the options for the design of the securing effect and the options of handling for the user of the crimping tool are increased. In the case that the securing device is a latching device, by actuation of the actuation organ the latching effect can be increased or decreased. Preferably, the manual actuation organ serves for locking and/or unlocking of a locking device forming the securing device. It is also possible that the manual actuation organ moves an additional securing element, where in a securing position the additional securing element secures or single-sidedly blocks a securing position taken up by a latching element, a friction element, a locking element and/or a spring element.

Alternatively or cumulatively to a manual actuation of the securing device via a manual actuation organ, an actuation of the securing device can be actuated and/or released in a motion-controlled way and/or a force-controlled way. This can be achieved in a way controlled by the motion of a plug in the accommodation. For example, with the insertion of the plug (motion control) a latching or locking element can be brought from a securing position into a non-securing position, in which then the complete insertion of the plug into the accommodation is possible. On the other hand, when reaching the latching or locking position, that is, also in a motion-controlled way, the return of the latching or locking element into the securing position is achieved. As explained before, a force control with the motion of the plug in the accommodation can consist of a release of a latching occurring when a threshold value of a removal force (which can be defined by a design of latching contour) is surpassed.

Alternatively or cumulatively, the securing device can be actuated and/or released in a motion-controlled way controlled by a motion of the accommodating body relative to a holding and/or guiding body or relative to a pliers head on which the holding and/or guiding body is held. This shall be explained in an exemplary way on the basis of a crimping tool locator in which the accommodating body is supported for being pivoted between an insertion position and a working position on the pulling and/or guiding body mounted to the crimping tool head: When the accommodating body "claps shut" into the working position, an actuation element of the holding and/or guiding body or the crimping tool head can approach a counter actuation element of the securing device or enter into interaction with the counter actuation element. For example, the actuation element can be an actuation pin which actuates a latching device or a friction device in such a way that the latching effect or friction force is induced or increased or a locking device is locked when the working position is approached.

Alternatively or cumulatively it is possible that the securing device is actuated and/or released in a motion-controlled way by a motion of driving elements or tool halves of the crimping tool. For example, for an increase of a latching effect or of friction or for the induction of a locking an actuation element can be moved together with the motion of the tool half or the die and enter into interaction with a counter actuation element of the securing device in order to induce the latching effect or the securing friction force or to increase it/them or to induce the locking. Possibly, in this way the manual actuation of the crimping tool can be used for the actuation of the securing device. Possibly, by using the transmission gear of the crimping tool, even by means of comparatively small hand forces large actuation forces for the securing device and therefore possibly large securing forces can be induced. An induction and/or increase of the securing effect with running through the working stroke and with the motion of the tool halves coming with it can for example be used in order to increase the securing effect of the workpiece in the accommodation during the plastic deformation of the workpiece, so that a change of the relative position of the workpiece with respect to the accommodation and therefore also with respect to the die due to the effective crimping forces can be avoided.

For a further proposal of the invention, a crimping tool locator of the kind explained before is employed in a crimping tool.

Advantageous developments of the invention result from the claims, the description and the drawings. The advantages of features and of combinations of a plurality of features mentioned at the beginning of the description only serve as examples and may be used alternatively or cumulatively without the necessity of embodiments according to the invention having to obtain these advantages. Without changing the scope of protection as defined by the enclosed claims, the following applies with respect to the disclosure of the original application and the patent: further features may be taken from the drawings, in particular from the illustrated designs and the dimensions of a plurality of components with respect to one another as well as from their relative arrangement and their operative connection. The combination of features of different embodiments of the invention or of features of different claims independent of the chosen references of the claims is also possible, and it is motivated herewith. This also relates to features which are illustrated in separate drawings, or which are mentioned when describing them. These features may also be combined with features of different claims. Furthermore, it is possible that further embodiments of the invention do not have the features mentioned in the claims.

The number of the features mentioned in the claims and in the description is to be understood to cover this exact number and a greater number than the mentioned number without having to explicitly use the adverb "at least". For example, if a die, a die half or an accommodation is mentioned, this is to be understood such that there is exactly one die, exactly one die half or exactly one accommodation, there are two dies, die halves or accommodations or there are more dies, die halves or accommodations.

Additional features may be added to these features, or these features may be the only features of the respective product.

The reference signs contained in the claims are not limiting the extent of the matter protected by the claims. Their sole function is to make the claims easier to understand.

BRIEF DESCRIPTION OF THE DRAWINGS

In the following, the invention is further explained and described with respect to preferred exemplary embodiments illustrated in the drawings.

DETAILED DESCRIPTION

Figure 1:
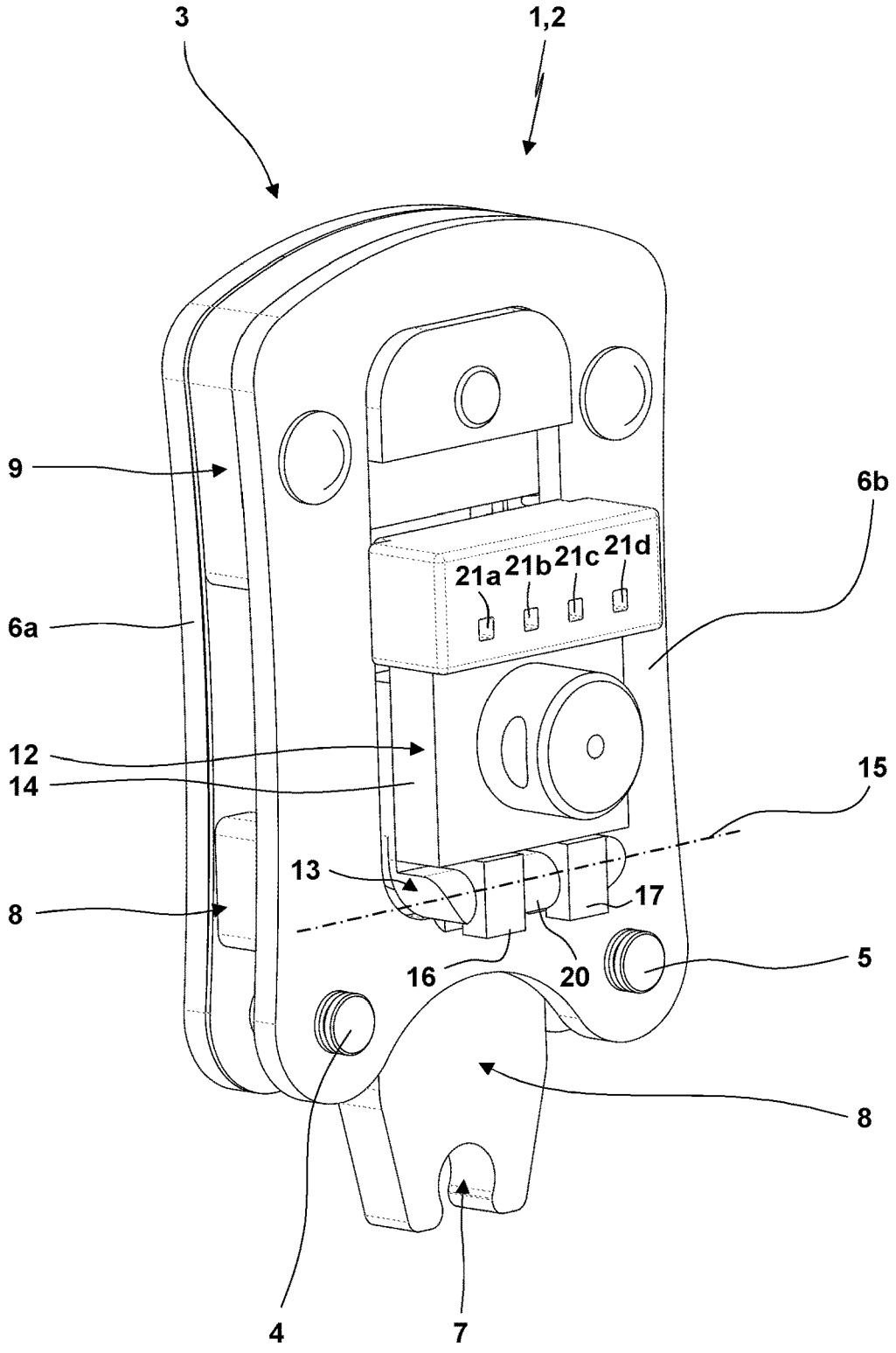
FIG. 1 in a three-dimensional view shows a pliers head of a crimping tool realized as manually actuated crimping pliers with a crimping tool locator.

FIG. 1 shows a detail of a crimping tool 1, that is, crimping pliers 2, in the region of a pliers head 3. An actuation of the crimping pliers is done manually via hand levers (not shown here), where a use of the design according to the invention is also possible for other crimping tools 1, possibly also with a non-manual actuation. With regard to the construction of the crimping pliers 2 chosen in exemplary way here, it is referred to the documents EP 2 463 969 A2 (corresponding to U.S. Pat. No. 8,601,856 B2), DE 40 23 337 C1 (corresponding to U.S. Pat. No. 5,153,984), DE 44 27 553 C2, DE 100 56 900 C1 (corresponding to U.S. Pat. No. 6,612,147 B2), DE 101 32 413 C2 (corresponding to U.S. Pat. No. 6,877,228 B2), DE 101 40 270 B4, DE 10 2007 038 626 B3 (corresponding to U.S. Pat. No. 8,296,956 B2), DE 10 2008 017 366 A1 and DE 10 2010 061 148 A1, which with regard to the construction of the crimping pliers 2 are incorporated by this reference to the present specification.

End regions of hand levers of the crimping pliers 2 are pivotably connected with each other via a hinge bolt. To each of the hand levers, an end region of a draw bar is linked. The other end region of each of the draw bars is linked to a supporting bolt 4, 5 of the pliers head 3. The supporting bolts 4, 5 are (possibly releasably) held on frame parts 6*a*, 6*b* of the pliers head 3 which in a first approximation are O-shaped. The hinge bolt pivotably connecting the hand levers of the crimping pliers 2 is supported in an accommodation 7 of a tool half 8. The tool half 8 is slidably guided along a longitudinal axis or crimping axis with respect to the frame parts 6*a*, 6*b*. Due to the mentioned draw bar connections a pivoting of the hand levers of the crimping pliers 2 towards each other leads to a motion of the tool half 8 along the longitudinal axis in a closing direction, in which way a working stroke of the crimping pliers 2 can be run through. A second tool half 9 is fixed to the frame parts 6*a*, 6*b*. On the tool halves 8, 9, at least one die half is formed each or at least one die body forming at least one die half is held. When running through the working stroke of the crimping pliers 2, the tool halves 8, 9 move towards each other until the die halves of the two tool halves 8, 9 corresponding to each other form a closed die. When running through the working stroke, the workpiece 10 (which is a plug 11 here) arranged between the tool halves 8, 9 and the corresponding die halves is crimped.

On the pliers head 3, a crimping tool locator 12 is held. The crimping tool locator 12 comprises a holding and/or guiding body 13, which on the one hand serves for holding or fixing on the pliers head 3 and on the other hand serves for the guiding of a motion of an accommodating body 14 relative to the pliers head 3 between an insertion position and a working position of the accommodating body 14 (and the other way around).

For the embodiment shown here, the relative motion of the accommodating body 14 with respect to the holding and/or guiding body 13 and therefore the pliers head 3 is a pivoting motion around a pivoting axis 15, which is oriented parallel to a pliers head plane defined by the frame parts 6 and vertically to the longitudinal and crimping axis. In order to achieve this, the holding and/or guiding body 13 comprises a pivoting bolt 20 which is fixedly or releasably held by the crimping tool half 8. The accommodating body 14 comprises arms 16, 17 which form bearing lugs 18, 19 oriented coaxially to the pivoting axis 15 for the pivoting bolt 20. For the embodiment shown, the bearing lugs 18, 19 are realized with open boundaries so that they can be "clicked" onto the pivoting bolt 20 under use of the elasticity of the arms 16, 17.

Figure 2:
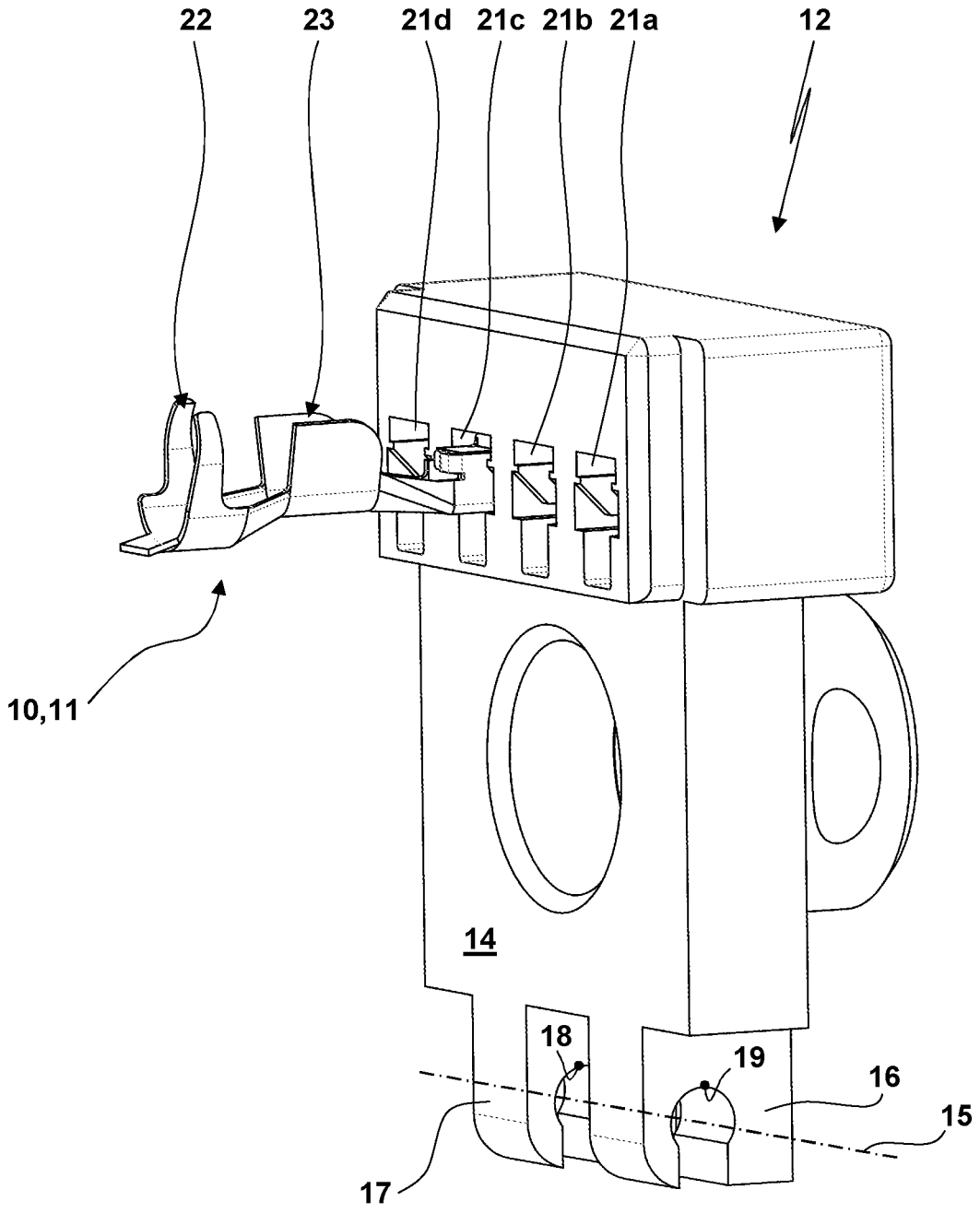
FIG. 2 in a three-dimensional view shows the crimping tool locator according to FIG. 1 with a workpiece realized as a plug inserted into an accommodation.

The accommodating body 14 can be realized as one-parted or multi-parted. As can be seen in FIG. 2, the accommodating body 14 comprises several accommodations 21*a*, 21*b*, 21*c*, 21*d* arranged side by side. The distance and the position of the accommodations 21 corresponds to the distance and the position of the die halves of the tool half 8. Furthermore, the accommodations 21 are arranged in such a way that in the working position of the crimping tool locator 12 they are arranged aligned with the die halves of the tool half 8.

FIG. 1 shows the working position of the crimping tool locator 12. In this working position, the main plane of extension of the accommodating body 14 is arranged parallel to the pliers head plane. The accommodations 21 are at a minimum distance from the die halves of the tool half 8 and are arranged aligned with them. Preferably, the accommodating body 14 is secured in the working position, which can be done for example by a magnet effective between the accommodating body 14 and the pliers head 3, by a latching or by a locking. From the working position, the accommodating body 14 can be pivoted around a pivoting axis 15 with a pivoting angle (for example in the region of 90° to 150°) into an insertion and removal position.

in the insertion and removal position of the accommodating body 14 a plug is inserted from the side turned towards the pliers head 3 into one of the accommodations 21 (which in FIG. 2 is the accommodation 21*c*). After the insertion of the plug 11, the plug 11 protrudes from the accommodation 21 on the side turned towards the pliers head 3 with deformation portions 22, 23. For working on the plug 11, the accommodating body 14 is pivoted back into the working position (FIG. 1), where the deformation portions 22, 23 extending from the accommodation 21 are arranged between the tool halves 8, 9 and between corresponding die halves. By going through the working stroke of the crimping pliers 2 the deformation portions 22, 23 can be crimped onto a cable.

Figure 4:
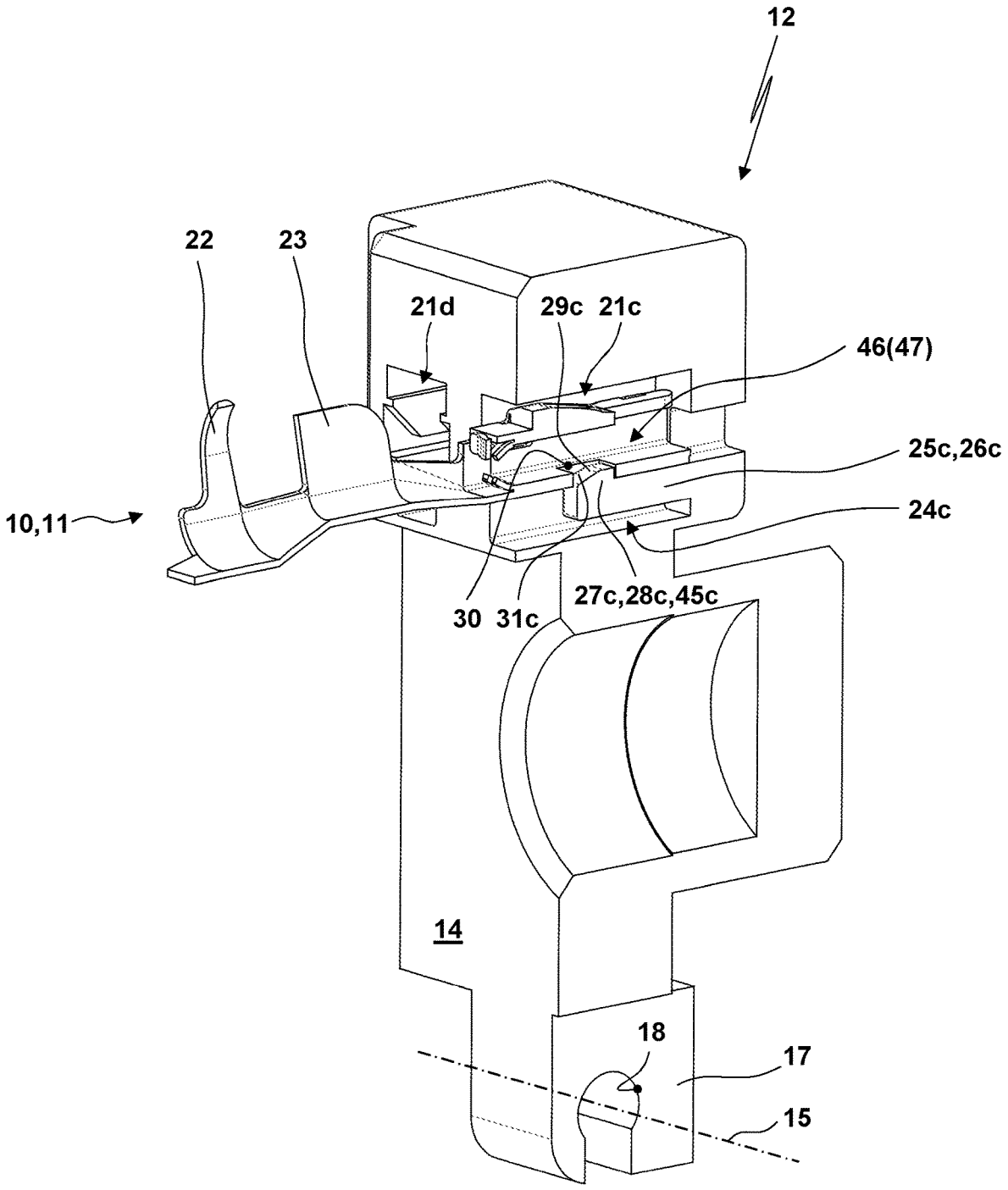
FIG. 4 in three-dimensional longitudinal section shows the crimping tool locator according to FIGS. 1 to 3 with a latching or locking of the plug via a securing device.

In FIG. 4 it can be seen that in each of the accommodations 21*a*, 21*b*, 21*c*, 21*d* a securing device 24*a*, 24*b*, 24*c*, 24*d* is arranged. By the securing device 24*a*, 24*b*, 24*c*, 24*d* a plug 11 arranged in the respective accommodation 21*a*, 21*b*, 21*c*, 21*d* can be secured. For the embodiment according to FIG. 4, the securing devices 24 comprise a spring element 25, which here is an elastic spring arm 26, and a latching element 27, which here is a latching lug 28 protruding in the direction of the plug 11. For the embodiment shown, the spring arm 26 and the latching lug 28 are realized as one piece by the accommodating body 14 (without this necessarily having to be the case). The latching lug 28 comprises a latching contour 29 via which the force conditions for a latching and an unlatching and therefore the securing effect of the securing device 24 can be influenced. The plug 11 comprises a latching recess 30, which is arranged in such a way that for a sufficient insertion of the plug into the accommodation 21 in the secured position of the securing device 24 the latching lug 28 is able to engage with the latching recess 30.

In the beginning of the insertion of a plug 11 into an accommodation 21, a front face and/or lower side of the plug 11 contacts an insertion inclination 31 formed by the latching contour 29 of the latching lug 28. An insertion force applied onto the plug 11 is transformed into a transverse force by the insertion inclination 31 which exerts a bending force onto the spring arm 26. When elastically biasing the spring arm 26 the latching lug 28 recedes downwards in FIG. 4, so that the front face of the plug 11 is able to pass the latching lug 28 and the plug 11 can be further inserted. The latching lug 28 while being elastically pressed by the spring arm 26 glides along the underside of the plug 11. When the latching lug 28 reaches the latching recess 30, due to the elastic biasing by the spring arm 26 the latching lug 28 latches with the latching recess 30. In this way the plug is secured in the accommodation 21 of the crimping tool locator 12.

If after the execution of the crimping process and after an opening of the crimping tool locator 12 the plug 11 with the cable crimped with it is to be removed from the accommodation 21, this can be achieved by sufficient removal forces which are applied onto the cable and the plug 11 and which by a corresponding insertion inclination of the latching contour 29 arranged on the other side are transformed into a transverse force. This transverse force elastically biases the spring arm 26 and leads to result that the latching lug 28 leaves the latching recess 30. In FIG. 4, a different realization is shown in which the latching contour 29 on the side opposite the insertion inclination 31 comprises a transverse plane oriented transverse to the removal direction. This leads to the result that a removal of the plug 11 from the accommodation 21 by applying a removal force is not possible. Rather than that, for a removal it is required to slightly incline the cable with the plug 11 in the accommodation 21. In this way the mentioned transverse plane is lifted above the latching lug 28 and a removal is made possible with the passing of the latching lug 28.

Figure 5:
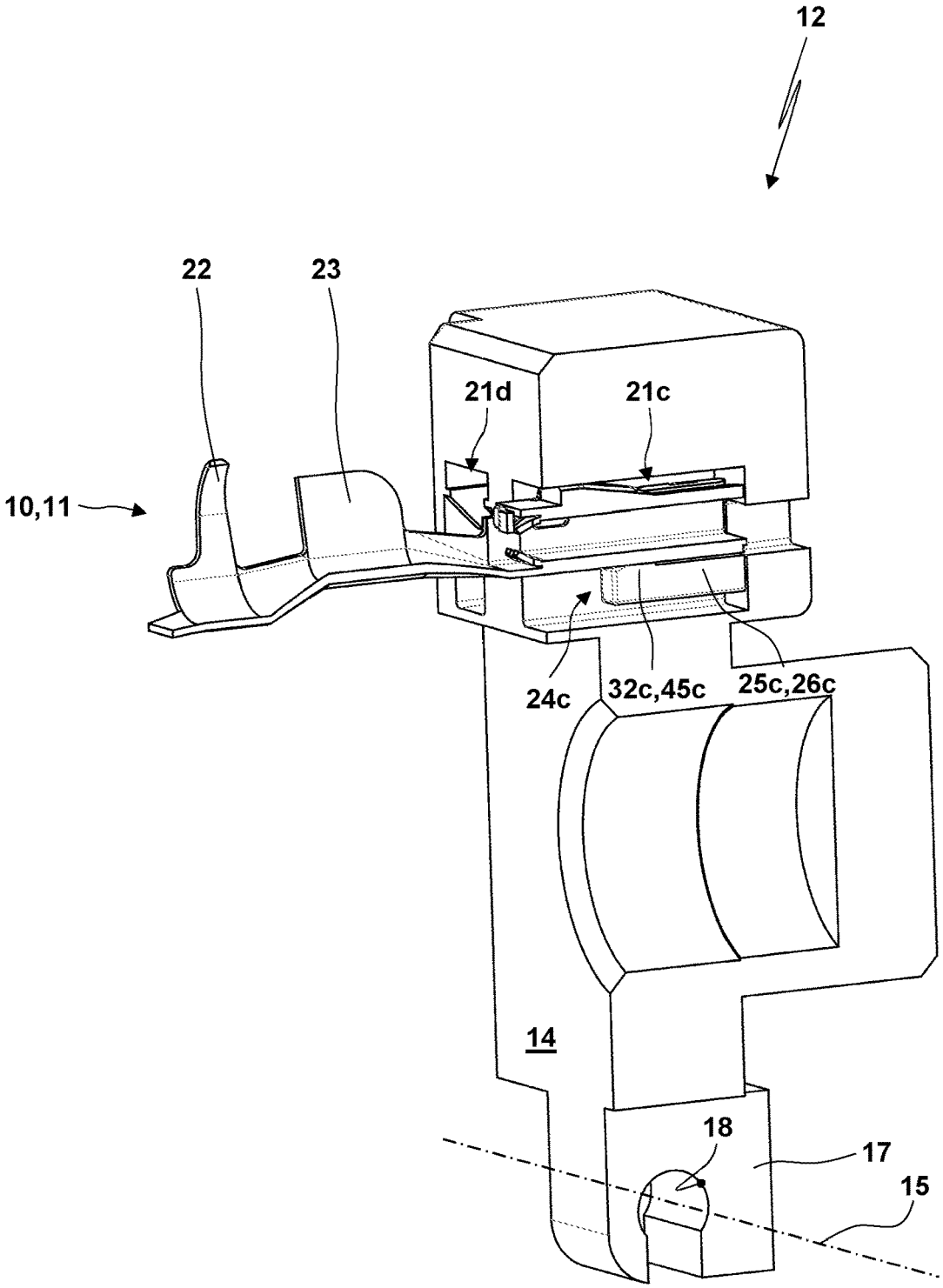
FIG. 5 in three-dimensional longitudinal section shows a crimping tool locator with a friction-locking securing of the plug via a securing device.

FIG. 5 shows a different embodiment wherein the plug 11 does not have a latching recess 30. In this case, in the free end portion the spring arm 26 forms or supports a friction element 32. With the insertion of the plug 11 into the accommodation 21 the friction element 32 is pressed against the plug 11 while elastically biasing the spring arm 26, while the plug 11 contacts the accommodation 21 on the side opposite the friction element 32. Therefore, for this embodiment the plug 11 is secured by friction in the accommodation 21.

Figure 6:
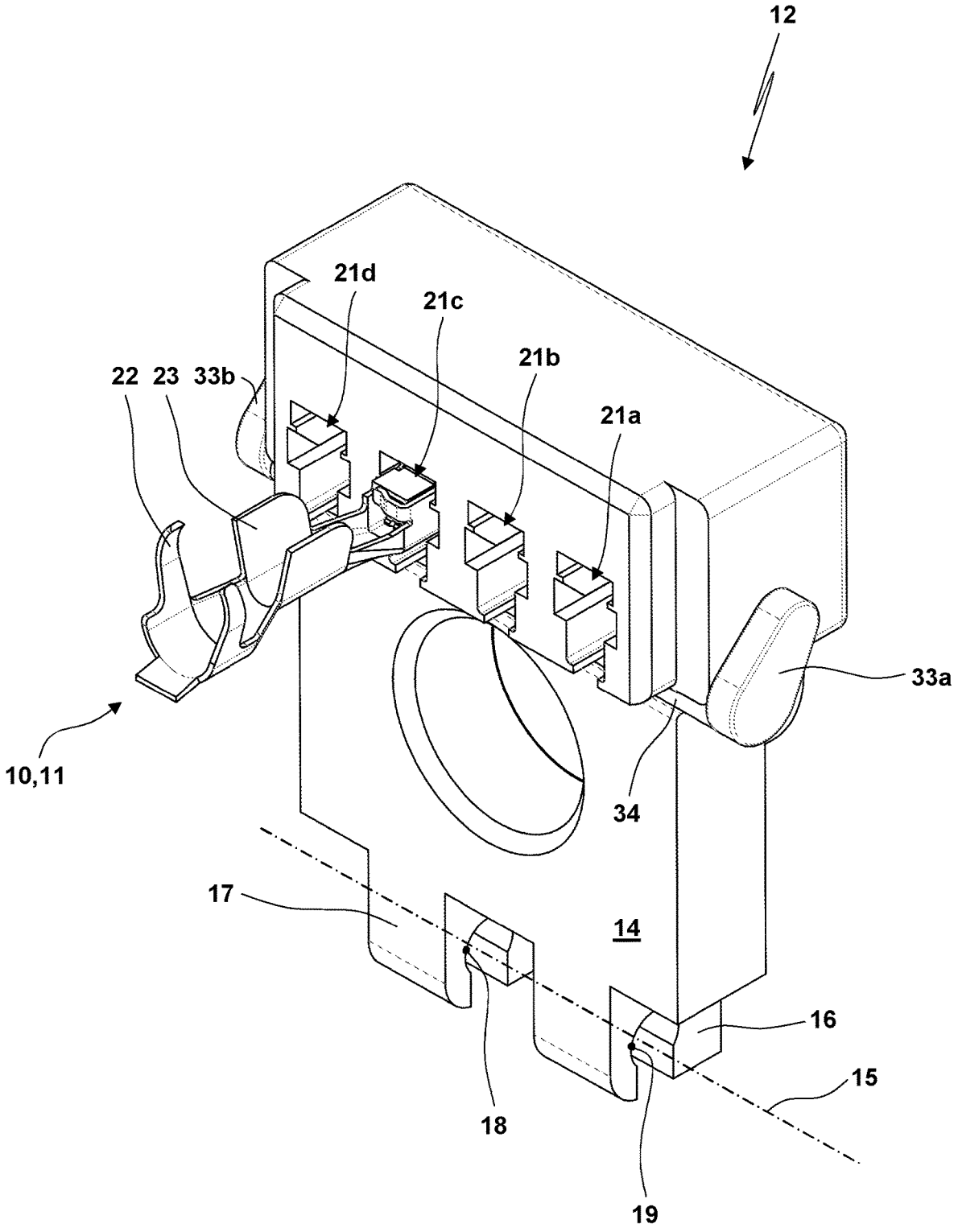
FIG. 6 in a three-dimensional representation shows a crimping tool locator with a locking of the plug via a securing device which can be locked and/or unlocked via a manual actuation organ.
Figure 7:
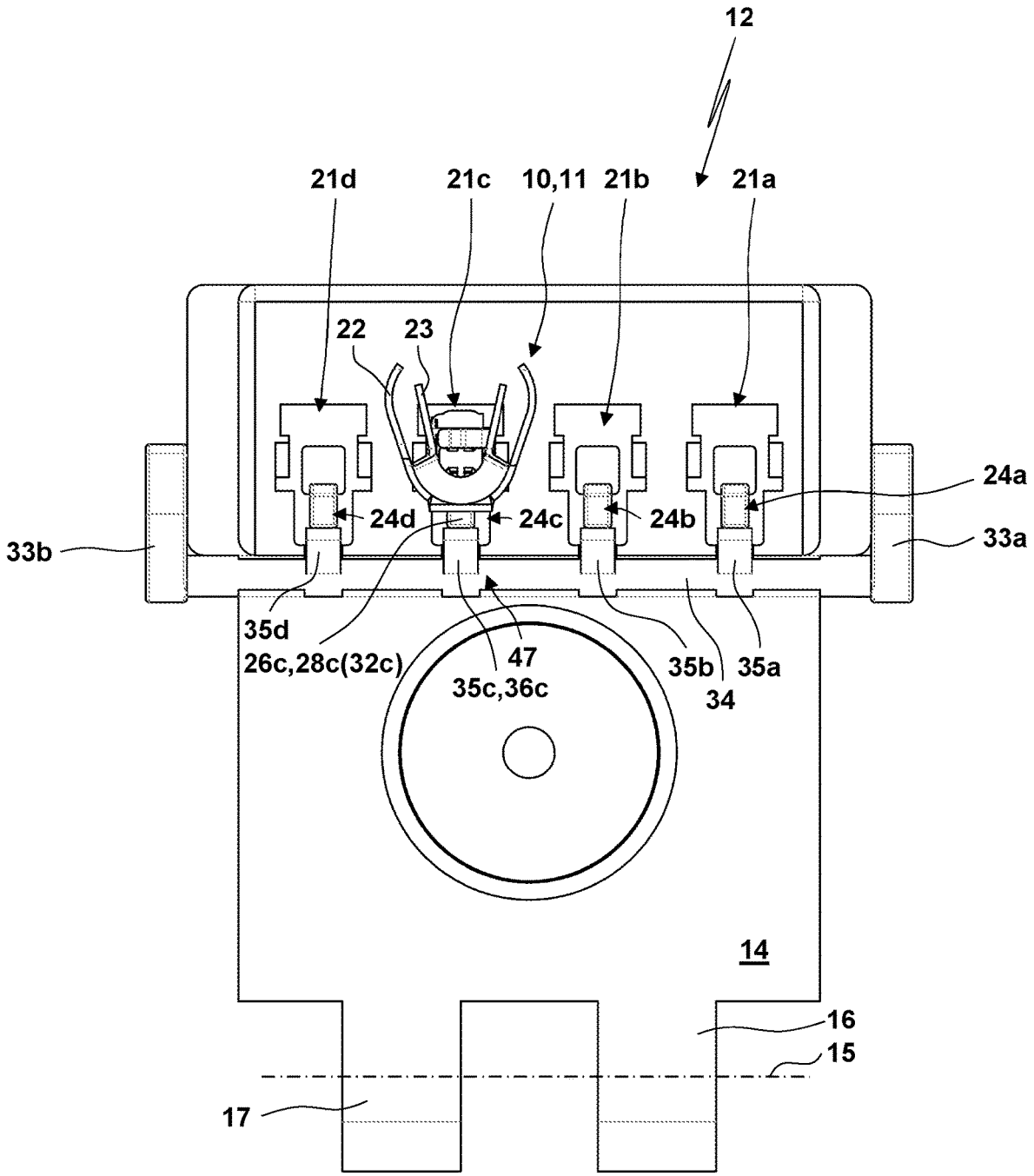
FIG. 7 in a front view shows the crimping tool locator according to FIG. 6.

FIGS. 6 and 7 show another embodiment. The crimping tool locator 12 comprises a manual actuation organ 33 by which the securing device 24 can be supported with regard to the securing effect, be held in its operating position, be manually operated and/or released. For the embodiment shown, two lever-like actuation organs 33*a*, 33*b* are arranged on both sides of the accommodating body 14. The actuation organs 33*a*, 33*b* are rotationally fixedly coupled with each other via an actuation shaft 34. The actuation shaft 34 is supported in the accommodating body 14. The actuation shaft 34 carries cams 35*a*, 35*b*, 35*c*, 35*d*. The cams 35*a*, 35*b*, 35*c*, 35*d* are each assigned to an accommodation 21*a*, 21*b*, 21*c*, 21*d* with an assigned securing device 24*a*, 24*b*, 24*c*, 24*d*. By means of a manual rotation of the actuation organ 33 and therefore of the actuation shaft 34 and the cams 35, one cam 35 is moved into contact with the spring arm 26, the latching lug 28 (FIG. 4) or the friction element 32 (FIG. 5) and/or the spring arm 26, the latching lug 28 (FIG. 4) or the friction element 32 (FIG. 5) can be biased towards the plug 11. Therefore, via the rotation of the actuation organ 33 the latching lug 28 can be moved into the latching recess 30 (FIG. 4) or the friction element 32 can be brought into a friction connection with the plug 11 or a present friction connection can be increased (FIG. 5). Alternatively or cumulatively it is possible that with the cams 35 an assumed securing position of the securing device 24 (especially a position of the spring arm 26, the latching lug 28 or the friction element 32) is secured, so that a receding of the spring arm 26 away from the plug 11 is blocked by the cam 35. Therefore the cams 35 form an additional securing element 36, which blocks or secures an assumed securing position of the spring arm 26, the latching lug 28 or the friction element 32. It is also possible that the cam 35 is resilient or that the actuation shaft 34 is elastically supported so that it is possible to elastically clamp the cam with the spring arm 26, the latching lug 28 or the friction element 32.

Figure 10:
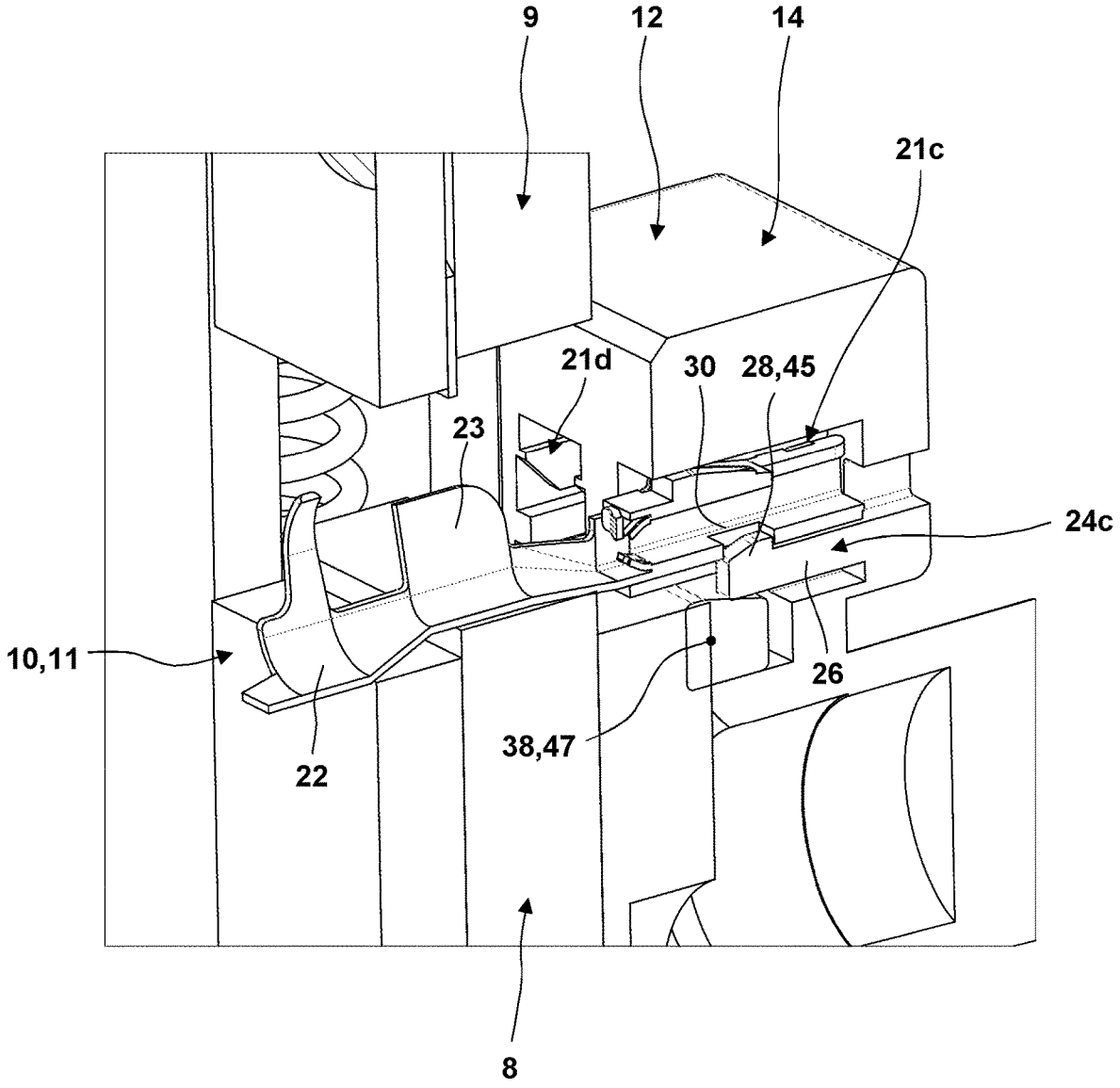
FIG. 10 in three-dimensional detailed view shows the pliers head with a crimping tool locator according to FIG. 9 held on it and a plug locked via the securing device.
Figure 11:
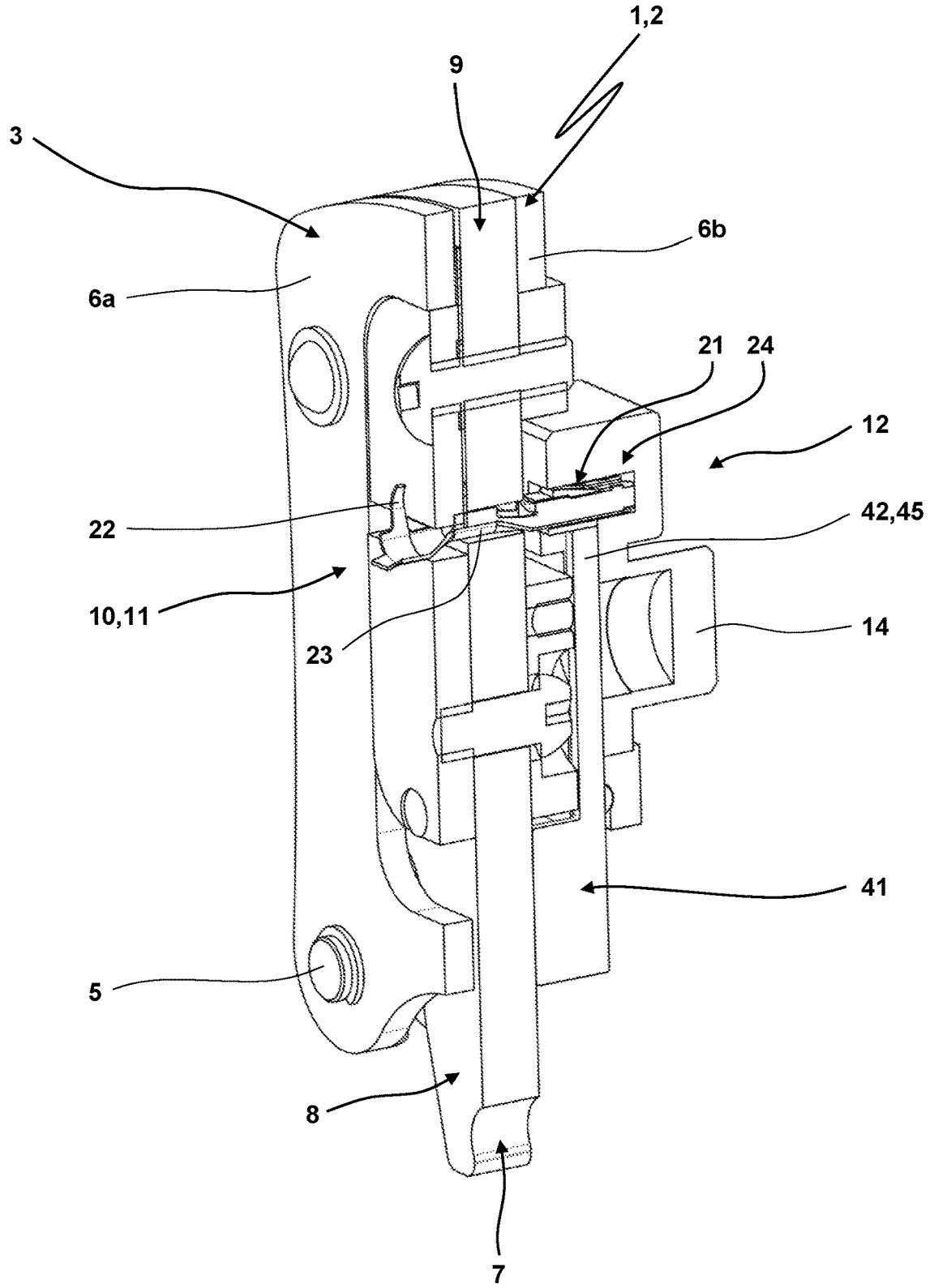
FIG. 11 in a three-dimensional longitudinal section shows a pliers head and crimping tool locator with a securing of the plug via a securing device which can be brought into the securing position via a motion of a die into the securing position.

For the embodiment shown in FIGS. 10 and 11, the securing element 36 is realized as a kind of bar or as a wedge-shaped or trapezoidal tensioning or blocking element 37. In the direction of movement of the accommodating body 14 the tensioning or blocking element 37 is supported slidably with respect to the accommodating body 14 relative to the pliers head 3 at the closing of the crimping tool locator 12. With the closing of the crimping tool locator 12, that is, the approaching of the accommodating body 14 to the pliers head 3, a front face 38 of the tensioning or blocking element 37 contacts the pliers head 3. Due to the contact force between the pliers head 3 and the front face 38 the tensioning or blocking element 37 is biased towards the interior of the accommodation 21. The tensioning or blocking element 37 comprises an inclined surface 39 which contacts the underside of the spring arm 26, the latching lug 28 or the friction element 32 and which converts a biasing force created on the front face 38 into a force which biases the spring arm 26, the latching lug 28 and/or the friction element 32 towards the plug 11. If the crimping tool locator 12 is held in the closing position, due to the tensioning or blocking element 37 the securing device 24 is secured in the secured position. For the embodiment shown, the separate tensioning or blocking elements 37*a*, 37*b*, 37*c*, 37*d* for the securing devices 24*a*, 24*b*, 24*c*, 24*d* are realized by a common tensioning or blocking rod 40. The actuation direction of the tensioning or blocking rod 40 is oriented tangentially to the pivoting axis 15.

In deviation to the embodiment shown, it is also possible that the tensioning or blocking rod 40 is mounted to the pliers head 3 and enters into interaction with the securing device 24 in the interior of the accommodating body 14. It is possible that between the pliers head 3, the tensioning or blocking elements 37*a*, 37*b*, 37*c*, 37*d* or the tensioning or blocking rod 40 and the securing device 24 an elasticity is interposed.

Figure 12:
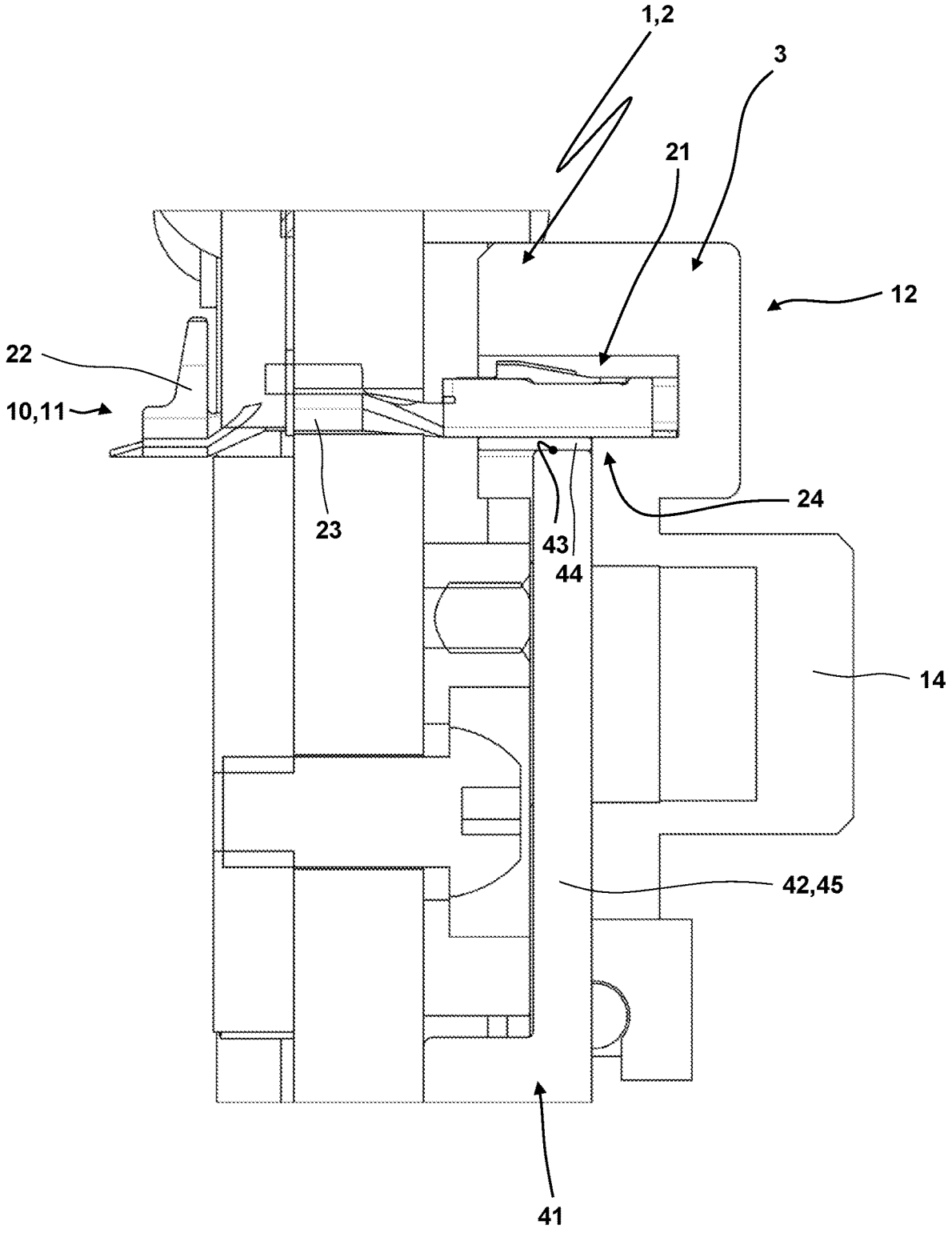
FIG. 12 shows the pliers head with the crimping tool locator according to FIG. 11 in a cutaway detail, where the securing device of the crimping tool locator is in the unsecured position.
Figure 13:
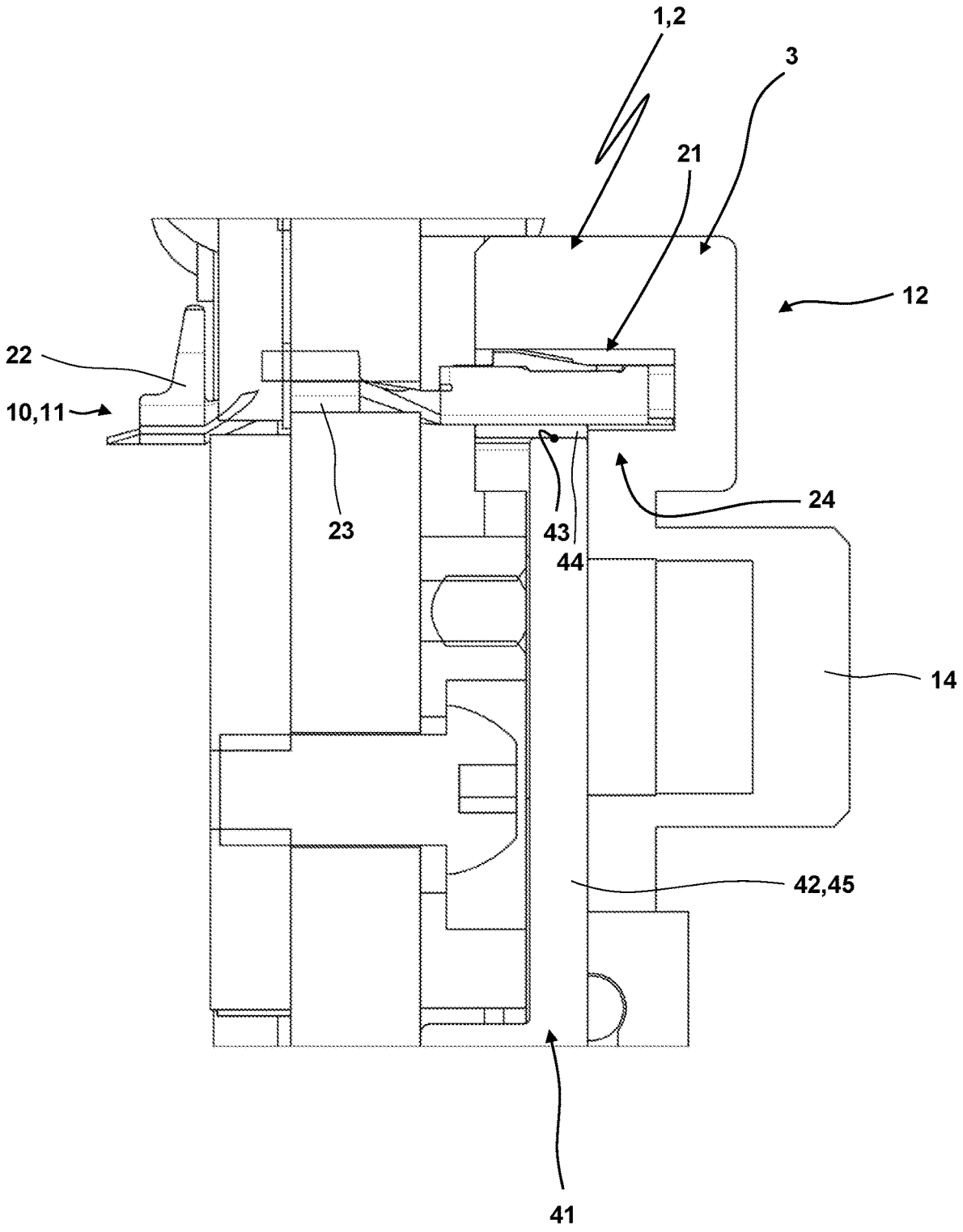
FIG. 13 shows the pliers head with the crimping tool locator according to FIG. 11 in a cutaway detail corresponding to FIG. 11, where the securing device of the crimping tool locator is in the secured position.

FIGS. 11 to 13 show an embodiment of a crimping tool 2 in which at first with the closing of the crimping tool locator 12 the securing device 24 is not yet in the secured position. Rather than that, the securing device 24 is brought into the secured position in a motion-controlled and automatized way along the working stroke (that is, along the motion of the tool half 8). In order to achieve this, an actuation organ 41 (especially an actuation tappet 42) is mounted to the tool half 8. The actuation organ 41 extends through the accommodating body 14 or between the accommodating body 14 and the pliers head 3 to the accommodation 21.

In the detail according to FIG. 12, an actuation position at the beginning of the working stroke of the crimping pliers 2 is shown. At the beginning of the working stroke, the tool half 8, the accommodating body 14 and the actuation organ 41 move together and in parallel to the longitudinal axis of the crimping pliers 2. At the beginning, the relative position of a front face 43 of the actuation tappet 42 and the accommodation 21 does not change, so that the actuation tappet 42 does not exert a securing effect onto the plug 11 arranged in the accommodation 21.

On the contrary, towards the end of the working stroke the accommodating body 14 contacts the tool half 9 or a frame part 6. As the working stroke is further gone through and the tool half 8 and the accommodating body 14 are biased in the crimping direction, the contact between the tool half 9 and the frame part 6 leads to a relative motion between the accommodating body 14 and the tool half 8. In order to achieve this, the accommodating body 14 is connected via elongated holes extending along the longitudinal axis to the tool half 8 or is to a certain extend held elastically by the tool half 8. The mentioned relative motion has the result that there is also a relative motion between the front face 43 of the actuation tappet 41 and the accommodation 21 with the plug 11 arranged in it. This relative motion in turn results in the front face 43 of the actuation tappet 41 pressing the plug 11 against an opposite limiting surface of the accommodation 21. In this way the plug 11 is secured by friction in the accommodation 21. This securing effect then only occurs at the end of the working stroke and can be used to additionally fix the plug 11 and to keep the plug 11 in the correct orientation at the end of the plastic deformation of the plug 11 with high crimping forces being effective on the plug 11 then. Preferably, the front face 43 biases the plug 11 via a friction and/or spring element 44.

For a different embodiment, an actuation organ 41 such as an actuation tappet 42 can also be mounted to the frame part 6 or the tool half 9 and extend from above through the accommodating body 14 into the accommodation 21. Then, in this way a relative motion between the accommodation 21 and the actuation organ 41 can occur over the entire working stroke.

Figure 3:
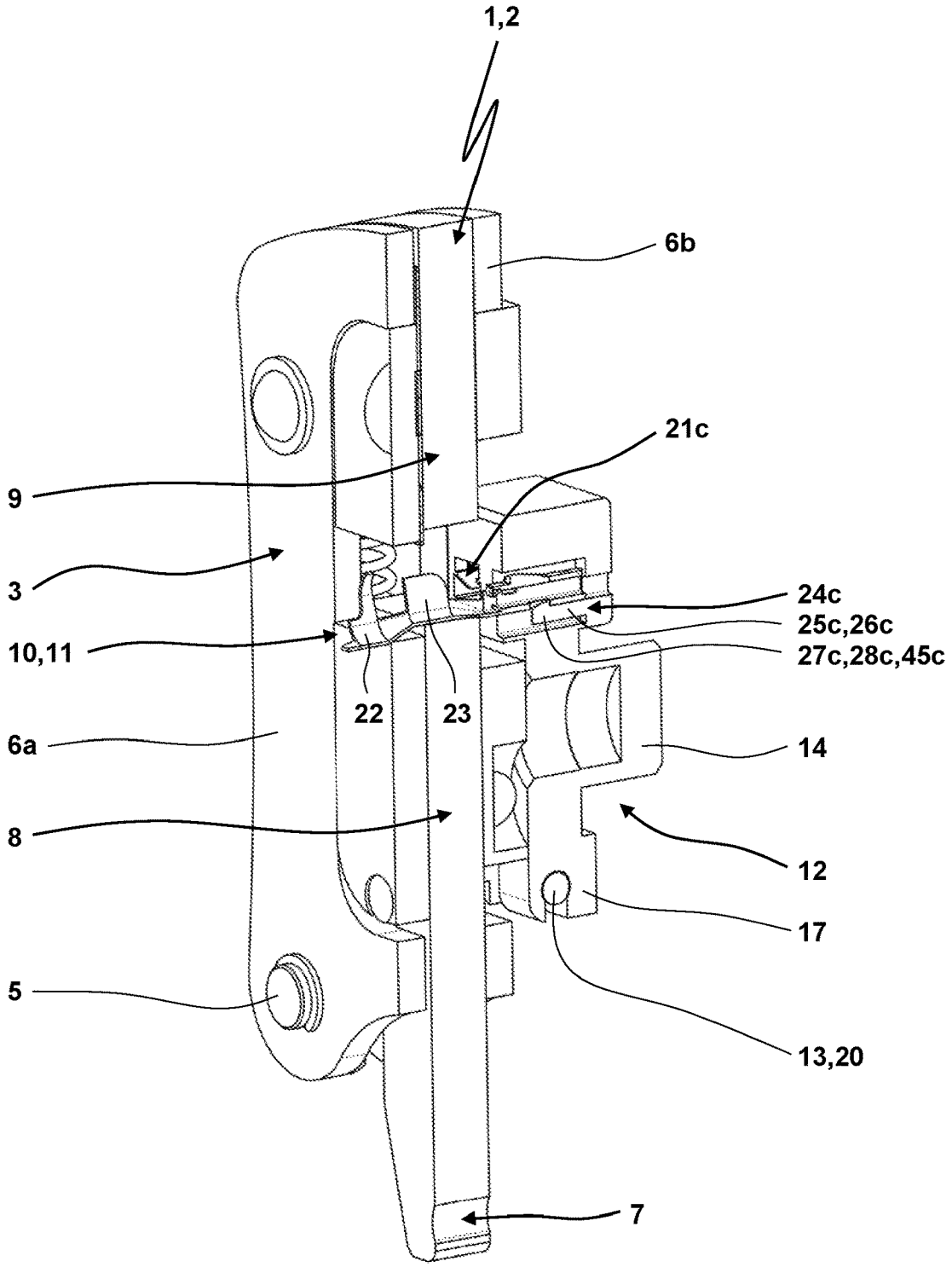
FIG. 3 in a three-dimensional longitudinal section shows the pliers head with the crimping tool locator according to FIGS. 1 and 2 during a working stroke.
Figure 8:
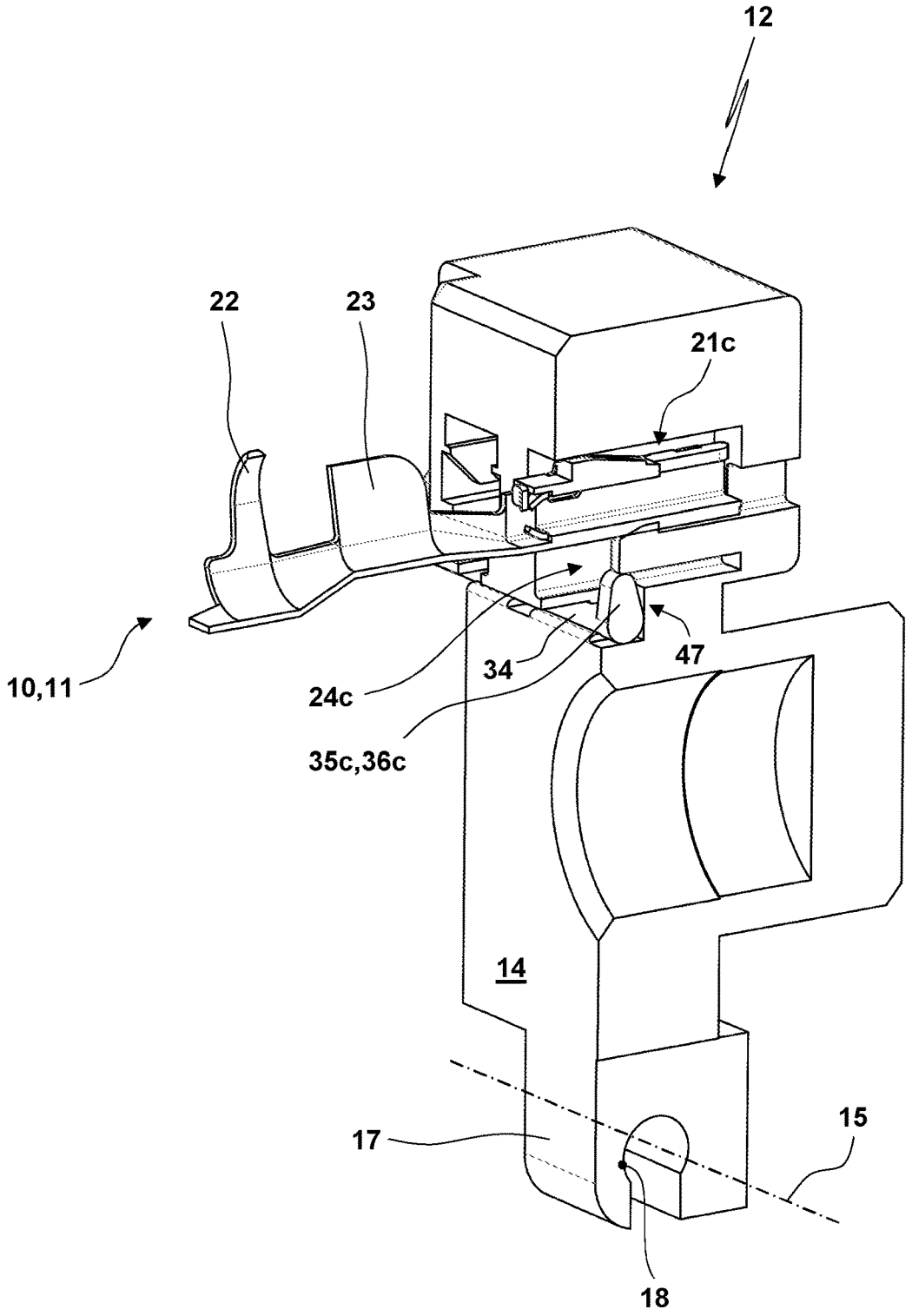
FIG. 8 in a three-dimensional longitudinal section shows the crimping tool locator according to FIGS. 6 and 7.
Figure 9:
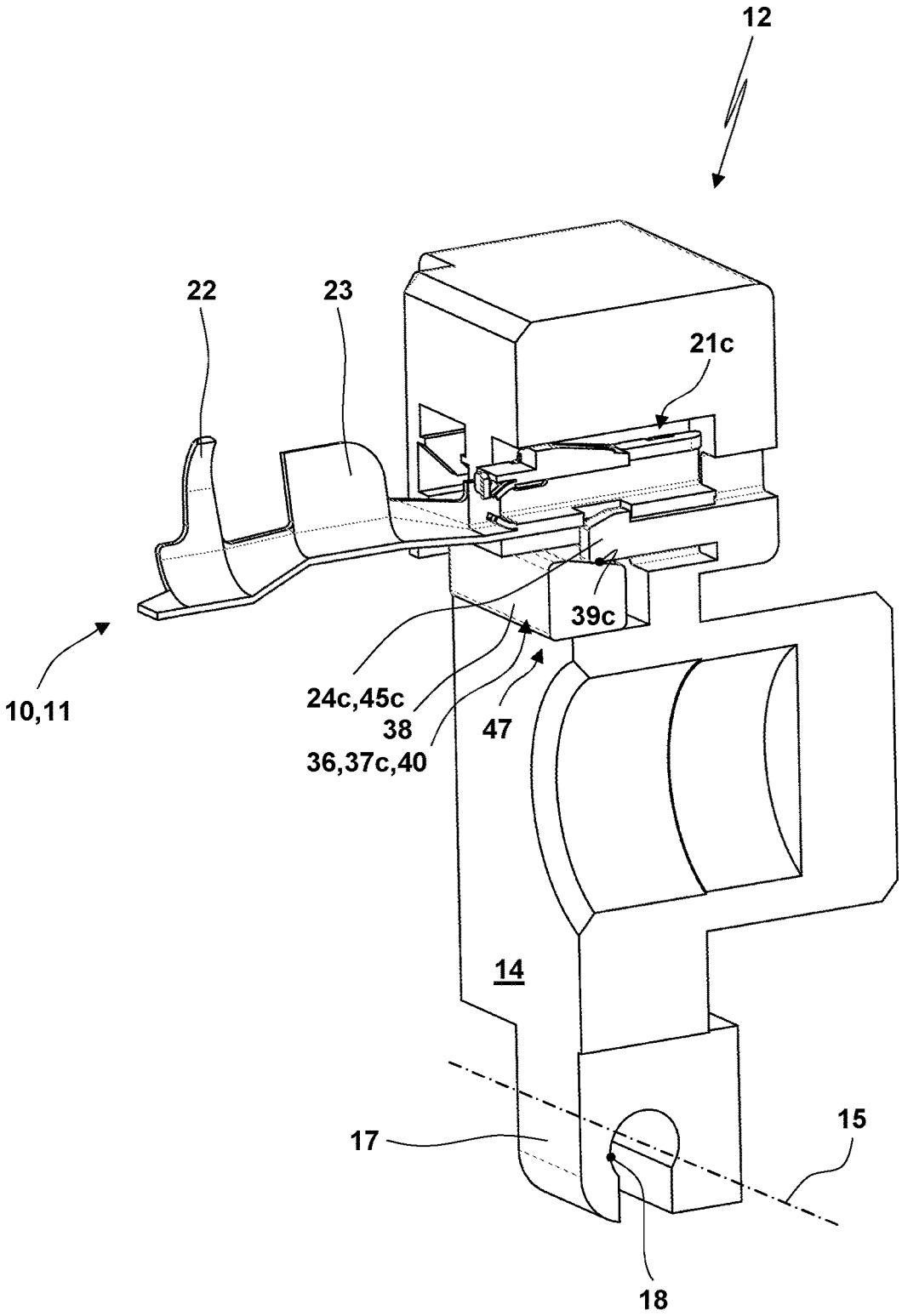
FIG. 9 in a three-dimensional longitudinal section shows a crimping tool locator with a locking of the plug via a securing device which can be locked and/or unlocked via a motion of an accommodating body relative to the pliers head.

For the embodiments shown, the latching element 27, the latching lug 28, the friction element 32, a cam 35, the actuation organ 41 or the actuation tappet 42 forms a securing element 45 of the securing device 24. This securing element 45 can be brought manually by the securing device 24, in a motion-controlled way by the closing of the crimping tool locator 12 or by the relative motion of the tool halves 8, 9 during the working stroke into a secured position in which the plug 11 (possibly in addition to another way of securing) is secured in the accommodation 21 and/or into an unsecured position in which the plug 11 is not additionally secured in the accommodation 21. The securing element 45 is moveable relative to the cross section of the accommodating body 14 limiting the accommodation 21 for the plug 11. This relative motion can for example be larger than 0.01 mm, larger than 0.02 mm, larger 0.05 mm, larger than 0.1 mm or even larger than 0.2 mm and can be induced by the forces effective for the induction of the motion of the securing element 45 (that is, especially the insertion forces and/or the removal forces for the plug according to FIGS. 3 to 5, the actuation forces for the actuation organ 33 according to FIGS. 6 to 8, the forces applied manually to the crimping tool locator 12 for the closing according to FIGS. 9, 10 or the crimping forces effective onto the tool half 8).

If the contact contours between the latching element 27 and the latching recess 30 comprise inclined surfaces, the securing device 24 realized with the spring element 25, the latching element 27 and the latching recess 30 is a latching device 46 which can be latched or unlatched for the application of sufficient insertion forces or removal forces onto the workpiece 10.

If, on the contrary, the contact contours between the latching element 27 and the latching recess 30 comprise transverse surfaces having an orientation transverse to the longitudinal axis of the accommodation 21, the securing device 24 is a locking device 47, which cannot be unlocked by pure application of removal forces. Also in the case that the securing device 24 comprises the actuation organ 33, the actuation shaft 34 and at least one cam 35, the securing device 24 forms a locking device 47 which secures the plug 11 by friction. For the removal of the plug 11 for the reduction of the friction force at first the crimping force has to be reduced by a rotating the actuation shaft 34.

The accommodating body may only comprise one accommodation 21 and one corresponding securing device 24. It is also possible that the accommodating body 14 comprises several accommodations 21*a*, 21*b*, . . . , where only single accommodations 21 or all accommodations 21 may each be equipped with a securing device 24*a*, 24*b*, . . . .

In the present description the same construction elements such as the accommodations 21*a*, 21*b*, . . . and the securing devices 24*a*, 24*b*, . . . are marked with the same reference signs. A differentiation is achieved by the additional letter a, b, . . . . If then such a reference sign is used without additional letter a, b, . . . , this can mean that in this place only one such construction element or several such construction elements is/are referred to.

The invention has been described on the basis of a special type of crimping pliers 2 with an O-shaped frame and tool halves driven via lugs or rods. The use of the invention, however, is not limited to this type of crimping pliers. Rather than that, the invention can be used in connection with any other type of crimping pliers, cp. the prior art mentioned in the beginning, or in any other crimping tool.

Furthermore, the invention has been described on the basis of a special type of a crimping tool locator 12, that is, a crimping tool locator in which the accommodating body 14 is pivoted about a transverse axis. The use of the invention, however, is not limited to this type of crimping tool locator 12. Rather than that, the invention can generally be used in connection with any other type of a crimping tool locator 12, especially a crimping tool locator according to the prior art mentioned in the beginning and/or a crimping tool locator with a pivoting of the accommodating body 14 around a longitudinal axis or with a translatory degree of freedom of the accommodating body 14 or an accommodating body 14 rotated in revolver-like way.

A crimping tool locator 12 can be an integral part of crimping pliers 2 or be mounted fixedly to a pliers head 3. It is also possible that a crimping tool locator 12 is an optional additional component which can be mounted with the crimping pliers 2 according to the variant of configuration or mode of use. Many variations and modifications may be made to the preferred embodiments of the invention without departing substantially from the spirit and principles of the invention. All such modifications and variations are intended to be included herein within the scope of the present invention, as defined by the following claims.

I claim:

1. A crimping tool locator for defining a position and/or orientation of a workpiece relative to a crimping tool having a crimping stroke, the crimping tool locator comprising:

an accommodating body with at least one accommodation for the workpiece formed in said accommodating body, said accommodation being adapted to receive the workpiece in a direction of insertion of the workpiece, the direction of insertion being parallel to a longitudinal axis of the accommodation, the longitudinal axis of the accommodation being parallel to a longitudinal axis of the workpiece when the workpiece is arranged in the accommodation; and said accommodating body comprising a securing device for securing the workpiece in the interior of the accommodation, said securing device comprising a spring arm and at least one of a latching element and a locking element, the spring arm and said at least one of the latching element and the locking element being designed and configured to interact with the workpiece within the accommodation when the workpiece is arranged in the accommodation for providing the securing effect at a location within the accommodation, wherein the at least one of the latching element and the locking element are not moved during the crimping stroke, and wherein the accommodating body is a single-piece part and the securing device is integrally formed with the accommodating body.

2. The crimping tool locator according to claim 1, wherein the crimping tool locator is designed and configured such that the securing device element can be transferred into a) a secured position in which the workpiece arranged in the accommodation is secured with the securing effect and b) an unsecured position in which a workpiece arranged in the accommodation is not secured with the securing effect.

3. The crimping tool locator according to claim 2, wherein the securing device comprises the spring arm and the latching element, but not the locking element.

4. The crimping tool locator according to claim 2, wherein the securing device comprises the spring arm and the locking element, but not the latching element.

5. A crimping tool locator for defining a position and/or orientation of a workpiece relative to a crimping tool having a crimping stroke, the crimping tool locator comprising:

an accommodating body with at least one accommodation for the workpiece formed in said accommodating body, said accommodation being adapted to receive the workpiece in a direction of insertion of the workpiece, the direction of insertion being parallel to a longitudinal axis of the accommodation, the longitudinal axis of the accommodation being parallel to a longitudinal axis of the workpiece when the workpiece is arranged in the accommodation; and said accommodating body comprising a securing device for securing the workpiece in the interior of the accommodation, said securing device comprising a spring arm and at least one of a latching element and a locking element, the spring arm and said at least one of the latching element and the locking element being designed and configured to interact with the workpiece within the accommodation when the workpiece is arranged in the accommodation for providing the securing effect at a location within the accommodation, wherein the at least one of the latching element and the locking element are not moved during the crimping stroke, wherein the securing device further comprises a manual actuation organ, said manual actuation organ being designed and configured to interact with at least one of the spring arm and said at least one of the latching element and the locking element to perform at least one of supporting the securing device with regard to the securing effect, holding the securing device in the secured position and actuating the securing device, wherein the crimping tool locator is designed and configured such that the securing device can be transferred into:

a) a secured position in which the workpiece arranged in the accommodation is secured with the securing effect; and b) an unsecured position in which a workpiece arranged in the accommodation is not secured with the securing effect.

6. The crimping tool locator according to claim 2, wherein the securing device is designed and configured for being actuated and/or released in a motion-controlled way.

7. A crimping tool locator for defining a position and/or orientation of a workpiece relative to a crimping tool having a crimping stroke, the crimping tool locator comprising:

an accommodating body with at least one accommodation for the workpiece formed in said accommodating body, said accommodation being adapted to receive the workpiece in a direction of insertion of the workpiece, the direction of insertion being parallel to a longitudinal axis of the accommodation, the longitudinal axis of the accommodation being parallel to a longitudinal axis of the workpiece when the workpiece is arranged in the accommodation; and said accommodating body comprising a securing device for securing the workpiece in the interior of the accommodation, said securing device comprising a spring arm and at least one of a latching element and a locking element, the spring arm and said at least one of the latching element and the locking element being designed and configured to interact with the workpiece within the accommodation when the workpiece is arranged in the accommodation for providing the securing effect at a location within the accommodation, wherein the at least one of the latching element and the locking element are not moved during the crimping stroke, and wherein the securing device is designed and configured for being actuated and released in a motion-controlled way by a movement of the accommodating body relative to a pliers head by which the crimping tool locator is held, wherein the crimping tool locator is designed and configured such that the securing device can be transferred into:

a) a secured position in which the workpiece arranged in the accommodation is secured with the securing effect; and b) an unsecured position in which a workpiece arranged in the accommodation is not secured with the securing effect.

8. A crimping tool locator for defining a position and/or orientation of a workpiece relative to a crimping tool having a crimping stroke, the crimping tool locator comprising:

an accommodating body with at least one accommodation for the workpiece formed in said accommodating body, said accommodation being adapted to receive the workpiece in a direction of insertion of the workpiece, the direction of insertion being parallel to a longitudinal axis of the accommodation, the longitudinal axis of the accommodation being parallel to a longitudinal axis of the workpiece when the workpiece is arranged in the accommodation; and said accommodating body comprising a securing device for securing the workpiece in the interior of the accommodation, said securing device comprising a spring arm and at least one of a latching element and a locking element, the spring arm and said at least one of the latching element and the locking element being designed and configured to interact with the workpiece within the accommodation when the workpiece is arranged in the accommodation for providing the securing effect at a location within the accommodation, wherein the at least one of the latching element and the locking element are not moved during the crimping stroke, and wherein the securing device is designed and configured for being actuated and released in a motion-controlled way by a movement of driving elements or tool halves of the crimping tool, wherein the crimping tool locator is designed and configured such that the securing device can be transferred into:

a) a secured position in which the workpiece arranged in the accommodation is secured with the securing effect; and b) an unsecured position in which a workpiece arranged in the accommodation is not secured with the securing effect.

9. A Crimping tool with the crimping tool locator according to one of the preceding claims.

10. The crimping tool locator according to claim 1, wherein the crimping tool comprises a pair of die halves that are movable about an open position, in which the die halves are spaced from each other, and a closed position, in which the die halves form a closed die.

11. The crimping tool locator according to claim 10, wherein in the open position, the die halves are spaced from the workpiece, and in the closed position, the die halves engage the workpiece.

12. The crimping tool locator according to claim 11, wherein the at least one of the latching element and the locking element is interactable with the workpiece within the accommodation when the die halves are in the open position and in the closed position.

13. The crimping tool locator according to claim 10, wherein the pair of die halves are spaced from the at least one of the latching element and the locking element a predetermined distance.

14. The crimping tool locator according to claim 10, wherein the at least one of the latching element and the locking element is not linkably coupled to the movable pair of die halves.

* * * * *